US006119482A

United States Patent [19]

Bianchi et al.

[11] Patent Number: 6,119,482

[45] Date of Patent: Sep. 19, 2000

[54] COMBINED PLANT OF A FURNACE AND AN AIR DISTILLATION DEVICE, AND IMPLEMENTATION PROCESS

[75] Inventors: Oswaldo Bianchi, Paris Cedex; Alain Guillard, Paris, both of France

[73] Assignee: L'Air Liquide, Societe Anonyme pour l'Etude et l'Exploitation des Procedes Georges Claude, Paris Cedex, France

[21] Appl. No.: 09/236,271

[22] Filed: Jan. 22, 1999

[30] Foreign Application Priority Data

Jan. 23, 1998 [FR] France ..... 98 00724

[51] Int. Cl.[7] ..... F25J 3/00

[52] U.S. Cl. ..... 62/646

[58] Field of Search ..... 62/646, 649, 644, 62/652

[56] References Cited

U.S. PATENT DOCUMENTS

| | | | |
|---|---|---|---|
| 4,382,366 | 5/1983 | Gaumer | 62/646 |
| 5,244,489 | 9/1993 | Grenier | 75/466 |
| 5,251,450 | 10/1993 | Agrawal et al. | 62/646 |
| 5,609,041 | 3/1997 | Rathbone et al. | 62/646 |

*Primary Examiner*—William Doerrler
*Attorney, Agent, or Firm*—Young & Thompson

[57] ABSTRACT

The combined plant comprises at least one furnace (FM) fed by a blowing machine (S), at least one air distillation device containing at least one medium-pressure column (MP) and a mixing column (CM) which has an oxygen outlet line (O) to feed the furnace (FM), the distillation device being fed via the blowing engine (S), at least the compressed air directed to the mixing column (CM) being given a positive pressure in at least one compressor-turbine group (C2-T2), the turbine (T2) of which is located in a circuit (Fi) for a pressurized fluid which is available at the plant site, for example steam or a gas originating from the furnace.

13 Claims, 3 Drawing Sheets

Figure 1:
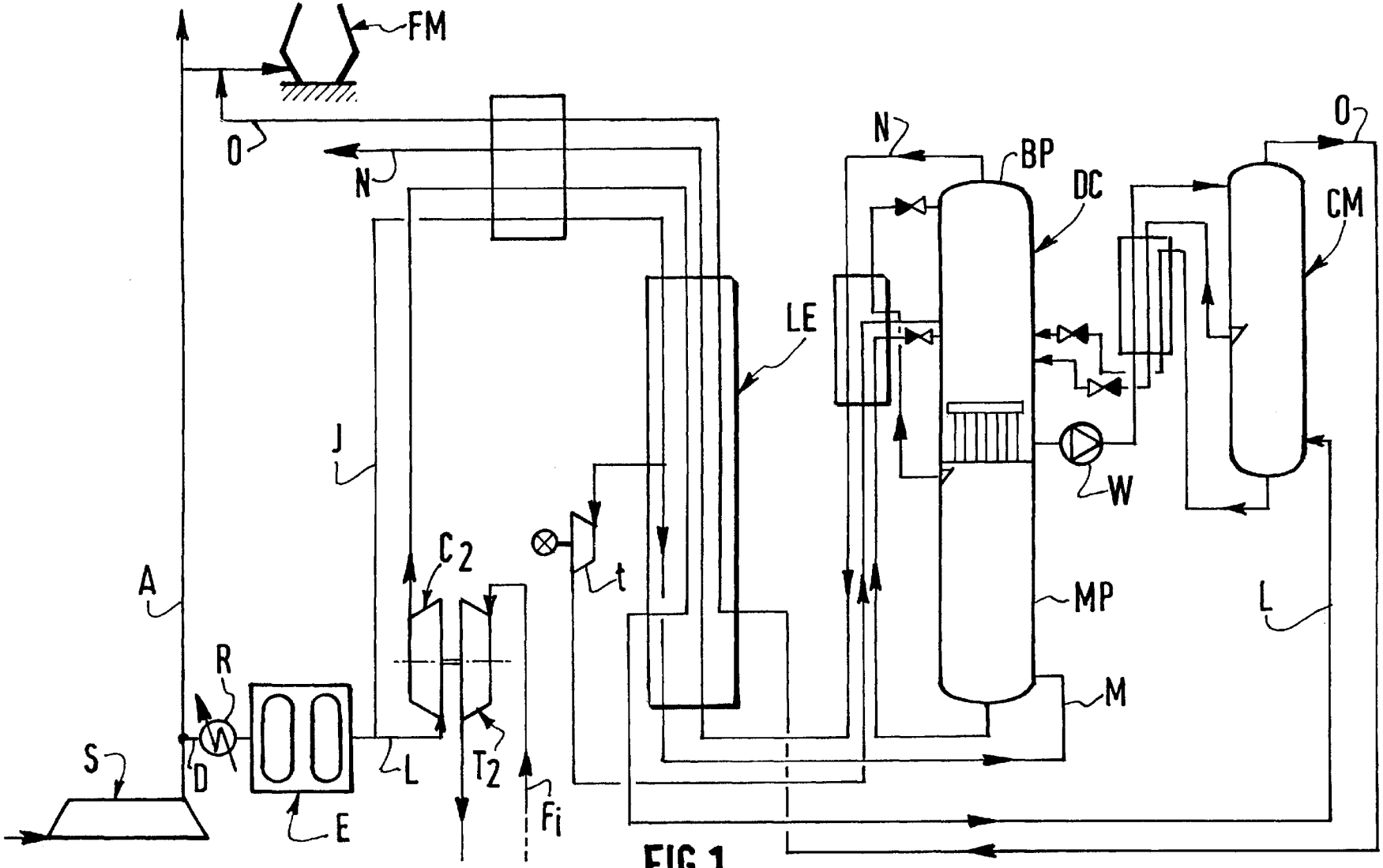

COMBINED PLANT OF A FURNACE AND AN AIR DISTILLATION DEVICE, AND IMPLEMENTATION PROCESS

The present invention relates to combined plants of at least one furnace, typically a metal-processing furnace, fed with compressed air, and of at least one device for distilling air which produces oxygen to enrich the air supplied to the furnace.

To enrich a flow of air, the production of high-purity oxygen is not required and the use of a distillation device containing a mixing column as described in document U.S. Pat. No. 4,022,030 (Brugerolle) is suitable. Combined plants of a blast furnace and an air distillation device which comprises such a mixing column are described in documents U.S. Pat. No. 5,244,489 (Grenier) and EP-A-0,531,182, in the name of the Applicant. However, the approaches followed in these two documents are at variance: in document U.S. Pat. No. 5,244,489, the distillation device is fed with air via a diversion of the blast from a blast furnace blowing engine and the part of the flow of air supplied to the mixing column is given a slight positive pressure by means of a blower driven by a cold-temperature-maintenance turbine which depressurizes the part of the flow of air directed to the medium-pressure column, in an arrangement which makes it necessary, in order to achieve the positive pressure, to turbine a large part of the air fed to the medium-pressure column, giving rise to losses of extraction yield and of energy, as well as oversizing of the stations for refrigerating and purifying the air fed to the distillation device. In contrast, document EP-A-0,531,182 envisages a complete separation of the air supply for the blast furnace, on the one hand, but also for the medium-pressure column and for the mixing column, on the other hand, in order to preselect the pressure in the mixing column over a wide pressure range, but at the price of high capital and running costs as regards the rotating machines which supply the sub-assemblies of the distillation device.

The aim of the present invention is to propose a combined plant of the type mentioned above, which is more fully integrated into the operating site and which allows substantially reduced running costs.

To do this, according to one characteristic of the invention, the combined plant comprises: at least one furnace, at least one blowing engine which delivers into a main compressed air line connected to the furnace, at least one air distillation device containing at least one medium-pressure column and a mixing column having an oxygen outlet line which opens into a downstream part of the main compressed air line, and an air diversion circuit connected to the main compressed air line via a purification device and supplying air to the medium-pressure column and to the mixing column and including at least one compressor-turbine group comprising at least one compressor for compressing the diverted air supplied at least to the mixing column, and at least one turbine located in a pressurized fluid circuit which is available at the plant site.

According to the invention, the distillation device uses not only a part of the flow of air from the blowing engine which is divertable on account of the subsequent re-injection of oxygen into this flow of air, but also the energy which can be extracted from a pressurized fluid generally available on-site, outside the distillation device, such as steam or residual process gases, which may be upgraded.

The present invention also relates to a process for using a combined plant comprising at least one furnace fed with compressed air via at least one blowing engine which supplies air at a first pressure, and fed with oxygen via an air separation device, comprising at least one medium-pressure column and a mixing column, fed with air via the blowing machine, in which the air supplied to at least the mixing column is given a positive pressure, to a second pressure which is greater than the first pressure, by means of at least one compressor driven by at least one turbine which depressurizes at least one compressed fluid generated on-site.

Figure 2:
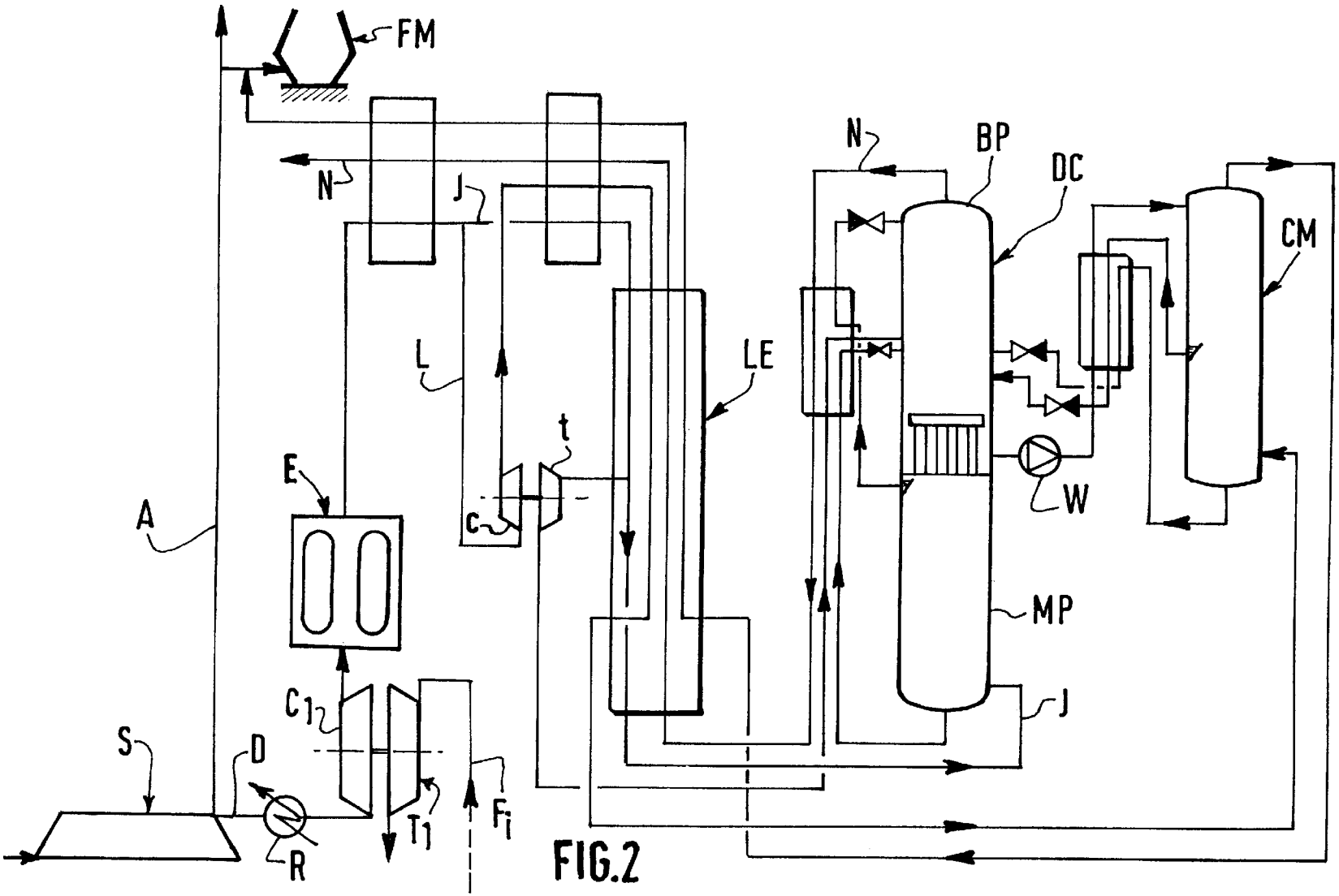
Figure 3:
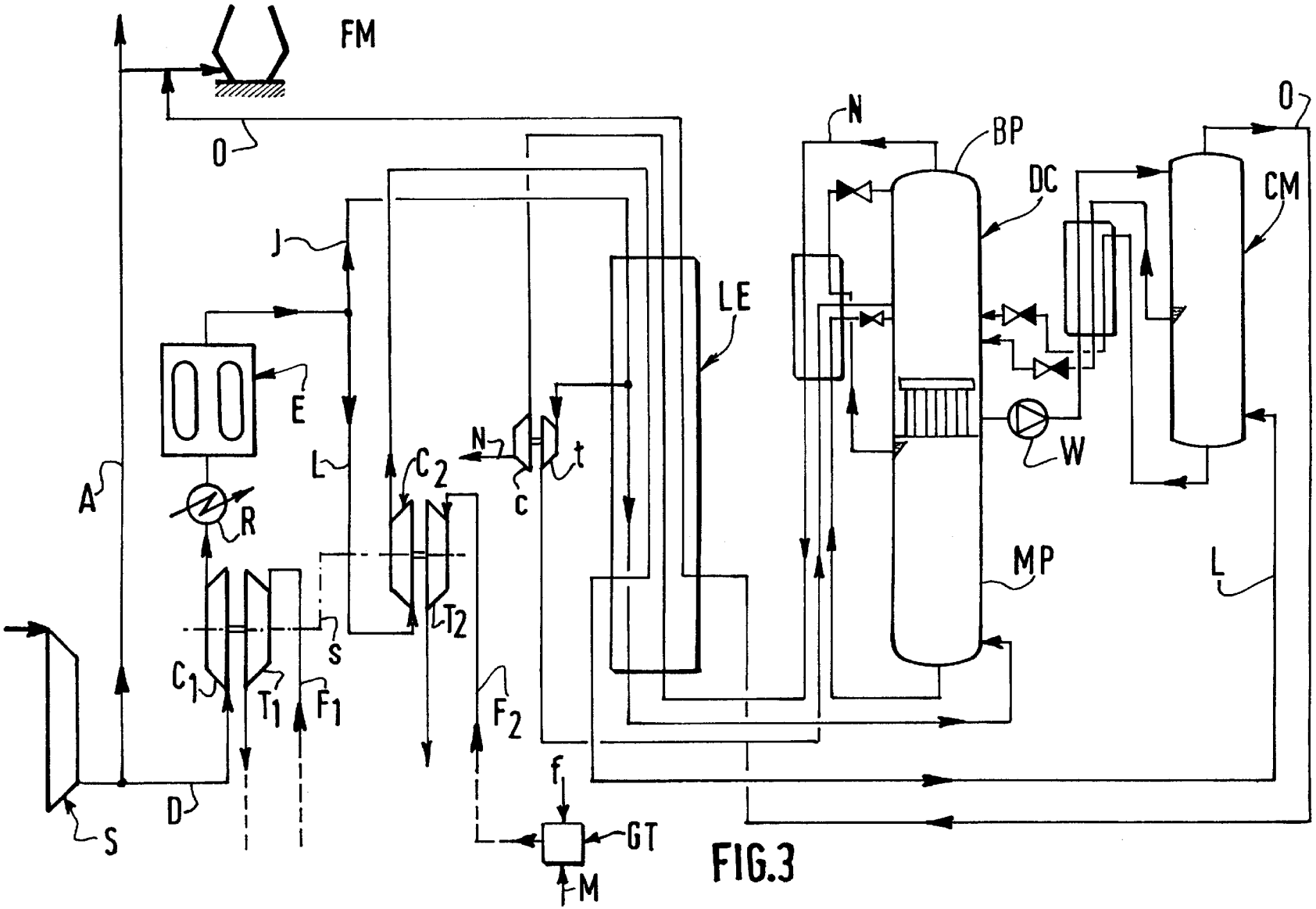

Other characteristics and advantages of the present invention will emerge from the following description of embodiments, given for illustrative but in no way limiting purposes, in relation to the attached drawings, in which:

FIGS. 1 to 3 are diagrammatic representations of three embodiments of the invention.

In the description which follows and in the drawings, the identical or similar components bear the same reference numbers, where indicated.

The figures diagrammatically represent a metal-processing furnace, in this instance a blast furnace FM, and an associated air distillation device, optionally comprising, in the examples represented, a main exchange line LE, a double column DC with a medium-pressure column MP and a low-pressure column BP, and a mixing column CM, the furnace and the distillation device being fed with air via the same blowing machine S which delivers, into a main compressed air line A feeding the furnace FM, a large volume of air (typically greater than 100,000 $Nm^3/h$) at a medium pressure $P_1$ of less than $6\times10^5$ Pa, typically between $3\times10^5$ Pa and $5.5\times10^5$ Pa. The line A can also feed, simultaneously or alternately, another metal-processing furnace, for example an electric furnace with the AOD process.

According to one aspect of the invention, an air diversion circuit D leaves from the main line A, this circuit feeding the distillation device with purified air in a purification device E, typically of the adsorption type, after precooling in a cooling device R. The diversion circuit D is divided, downstream of the purification apparatus E, into a first line J which crosses the exchange line LE to open into the bottom of the medium-pressure column MP, and into a second line L which also crosses the exchange line LE and opens into the bottom of the mixing column CM. Conventionally, a line N of medium-purity nitrogen gas leaves from the top of the low-pressure column BP and a line O of medium-purity oxygen leaves from the top of the mixing column CM and, according to the invention, after crossing the exchange line LE, opens into the main compressed air line A upstream of the furnace FM in order to enrich with oxygen the air supplied to this furnace.

In the embodiments represented, purely for the purposes of example, the distillation device is of the conventional double-column type DC, with a turbine t for depressurizing, to the low pressure of the low-pressure column BP, some of the inlet air supplied by the first line M and serving to keep the distillation device cold, and with a pump W which compresses the liquid oxygen taken from the bottom of the low-pressure column BP and conveyed to the top of the mixing column CM more or less at the pressure $P_2$ of the air, cooled to about its dew point, introduced via the line L. According to the invention, this pressure $P_2$ is chosen slightly greater than the pressure $P_1$ in the main line A in order to take account of the losses of pressure in the warm air/oxygen mixing devices downstream of the line A and to optimize the regulation of this injection. Typically $P_2-P_1$ is between $0.3\times10^5$ Pa and $4\times10^5$ Pa, advantageously between $0.5\times10^5$ Pa and $1.5\times10^5$ Pa.

According to the invention, the air at this pressure $P_2$ is obtained by means of at least one compressor/turbine group $C_1T_1$ which compresses the air at least in the line L, the turbine $T_1$ depressurizing a pressurized fluid F available at the plant site, outside the distillation device, typically a residual process gas or an excess process gas. Conventionally, the fluid $F_1$ will be steam, which is generally generated in abundance on-site to cool the constituents thereof, and is available at pressures typically ranging between $3\times10^5$ Pa and $15\times10^5$ Pa, and only a small portion of which is generally upgraded, in particular to produce a cold temperature or electrical power. The fluid $F_1$ can also be a residual warm gas leaving the furnace FM, which can be depressurized directly or partially converted into a combustible gas which serves as a fuel f for a compressor-turbine group containing a combustion chamber GT, represented in FIG. 3, which advantageously uses at least one of the gases from the air supplied by the lines N and O and serves to produce energy, some of the flow compressed by the compressor in this group being transferred to the turbine $T_1$.

In the embodiment in FIG. 1, the compressor-turbine group $C_2$-$T_2$ is located in the line L and serves merely to give a positive pressure to the flow of air supplied to the mixing column CM.

In the embodiment in FIG. 2, the compressor-turbine group $C_1$-$T_1$ is located in the line D, upstream of the purification device E, and thus gives a positive pressure to all of the air conveyed to the distillation device. In this embodiment, the positive pressure, at a pressure which is intermediate between $P_1$ and $P_2$, of the air supplied to the medium-pressure column MP is used in the cold-temperature-maintenance turbine t to drive a blower c located in the line L and which creates the positive pressure required to reach the pressure $P_2$ in the mixing column CM.

The embodiment in FIG. 3 is a combination of the embodiments in FIGS. 1 and 2: in this variant, a first compressor-turbine group $C_1$-$T_1$, driven by a first pressurized fluid $F_1$, is located in the line D, upstream of the purification device E, and a second compressor-turbine group $C_2$-$T_2$, driven by a second pressurized fluid $F_2$, is located in the line L dedicated to the mixing column CM. The fluid $F_2$ can be supplied from a gas turbine group GT as mentioned above and the fluid $F_1$ can be steam. As a variant, as shown by the dotted branch line s, the two compressors $C_1$, $C_2$ can be driven by the same turbine or by the same group of turbines $T_1/T_2$ which depressurize the same pressurized fluid $F_1$.

In this embodiment in FIG. 3, the pressure in the line J which feeds the double column is exploited by coupling the cold-temperature-maintenance turbine t to a blower c which serves to give a positive pressure to one of the fluids entering or leaving the distillation device, for example, as represented in FIG. 3, the impure nitrogen in the line N, in order to help upgrade this impure nitrogen, for example introduced as ballast into the combustion chamber of the gas turbine group GT.

Although the present invention has been described in relation to specific embodiments, it is not limited thereto but can be subject to modifications and variants which will become apparent to those skilled in the art and which remain in the context of the claims below.

What is claimed is:

1. Combined plant comprising: at least one furnace, at least one blowing engine which delivers into a main compressed air line connected to the furnace, at least one air distillation device containing at least one medium-pressure column and a mixing column having an oxygen outlet line which opens into a downstream part of the main compressed air line, and an air diversion circuit connected to the main compressed air line via a purification device and supplying air to the medium-pressure column and to the mixing column and including at least one compressor-turbine group comprising at least one compressor for compressing the diverted air supplied at least to the mixing column, and at least one turbine located in a pressurized circuit fed by a fluid other than a fluid from or to said air distillation device.

2. Plant according to claim 1, wherein at least one compressor of a said compressor-turbine group is located in an upstream part of the diversion circuit, before the purification apparatus.

3. Plant according to claim 1, wherein at least one compressor of a said compressor-turbine group is located in a line feeding air to the mixing column.

4. Process for using a combined plant comprising at least one furnace fed with compressed air via at least one blowing engine which supplies air at a first pressure $P_1$, and fed with oxygen via an air separation device, comprising a medium-pressure column and a mixing column, fed with air via the blowing machine, in which the air supplied to at least the mixing column is increased in pressure, to a second pressure $P_2$ which is greater than the first pressure $P_1$, by means of at least one compressor driven by at least one turbine which depressurizes at least one compressed fluid other than a fluid from or to said air distillation device.

5. Process according to claim 4, wherein $P_1$ is less than $6\times10^5$ Pa.

6. Process according to claim 5, wherein $P_2-P_1$ is greater than $0.3\times10^5$ Pa.

7. Process according to claim 6, wherein $P_2-P_1$ is less than $4\times10^5$ Pa.

8. Process according to claim 4, wherein all of the air flow supplied to the separation device is increased in pressure in a said compressor.

9. Process according to claim 8, wherein the air flow transferred to the mixing column is again given a positive pressure.

10. Process according to claim 9, wherein the air flow transferred to the mixing column is again increased in pressure in a said compressor.

11. Process according to claim 4, wherein only the air flow transferred to the mixing column is increased in pressure by a said compressor.

12. Process according to claim 4, wherein the compressed fluid is steam.

13. Process according to claim 4, wherein the compressed fluid is compressed by means of a compressor-gas turbine group which uses a fuel which is available on-site.

* * * * *